US005546726A

United States Patent [19]

Stalzer

[11] Patent Number: 5,546,726

[45] Date of Patent: Aug. 20, 1996

[54] RAFTER-TO-SUPPORT-MEMBER CONNECTION APPARATUS

[76] Inventor: Michael E. Stalzer, 2540 S. Ingram Mill Rd. 3327, Springfield, Mo. 65804

[21] Appl. No.: 347,697

[22] Filed: Dec. 1, 1994

[51] Int. Cl.[6] ..... E04C 5/18

[52] U.S. Cl. ..... 52/702; 52/93.2; 52/105; 52/289; 52/712; 52/714; 52/715

[58] Field of Search ..... 52/702, 712, 714, 52/715, 289, 92.2, 92.3, 93.1, 94, 105, 93.2; 403/231, 232.1, 256, 258, 260

[56] References Cited

U.S. PATENT DOCUMENTS

| | | | |
|---|---|---|---|
| 3,256,030 | 6/1966 | Banse | 52/712 X |
| 3,423,898 | 1/1969 | Tracy et al. | 52/702 X |
| 3,596,941 | 8/1971 | Tracy | 403/232.1 X |
| 4,330,971 | 5/1982 | Auberger | 52/712 X |
| 4,976,085 | 12/1990 | Krueger | 52/715 |

*Primary Examiner*—Wynn Wood
*Assistant Examiner*—Christopher Todd Kent

[57] ABSTRACT

A rafter-to-support-member connection apparatus includes a single-piece, substantially two-dimensional blank which includes a longitudinal portion and a transverse portion projecting transversely from the longitudinal portion. The longitudinal portion includes a first end region and a second end region. The transverse portion includes transverse connection apertures. A plurality of indicia are located at predetermined crease line locations on the longitudinal portion. The transverse portion and the first end region and the second end region of the longitudinal portion are adapted to be bent with respect to each other along predetermined locations on the transverse portion and the longitudinal portion to form a three-dimensional structure. In one embodiment, the rafter-to-support-member connection apparatus provides an adjustable fascia rafter connection apparatus to connect a wood or metal fascia to the plumb end of a structural metal rafter. In a second embodiment, the rafter-to-support-member connection apparatus provides an adjustable plumb end valley rafter connection which is used to connect a structural metal tubing valley jack rafter to a wood or metal valley rafter. In a third embodiment, the rafter-to-support-member connection apparatus provides an adjustable plumb end common rafter connection which is used to connect a structural metal tubing rafter to a wood or metal ridge beam.

3 Claims, 6 Drawing Sheets

FIG 1
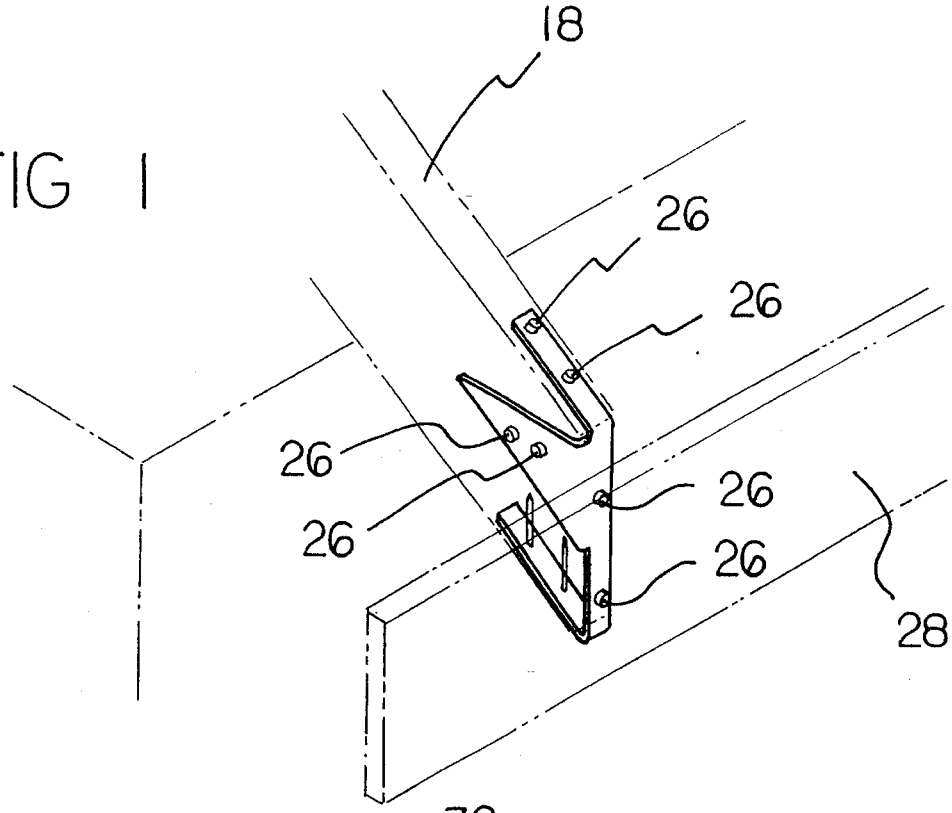
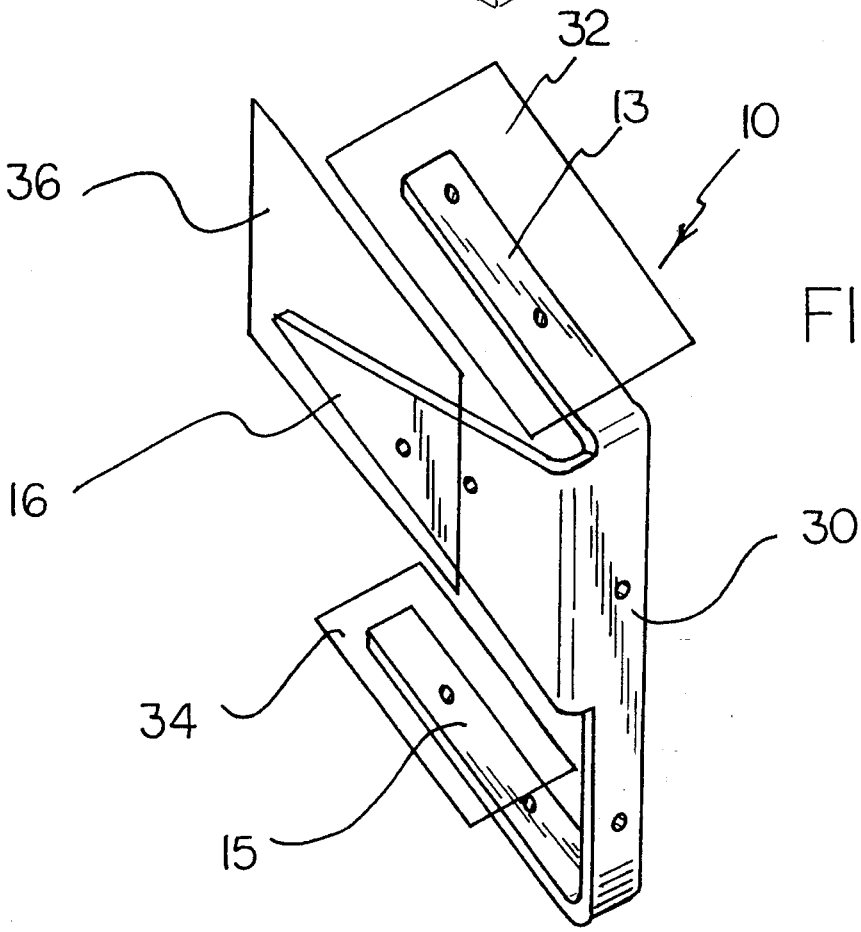
FIG 2

FIG 5
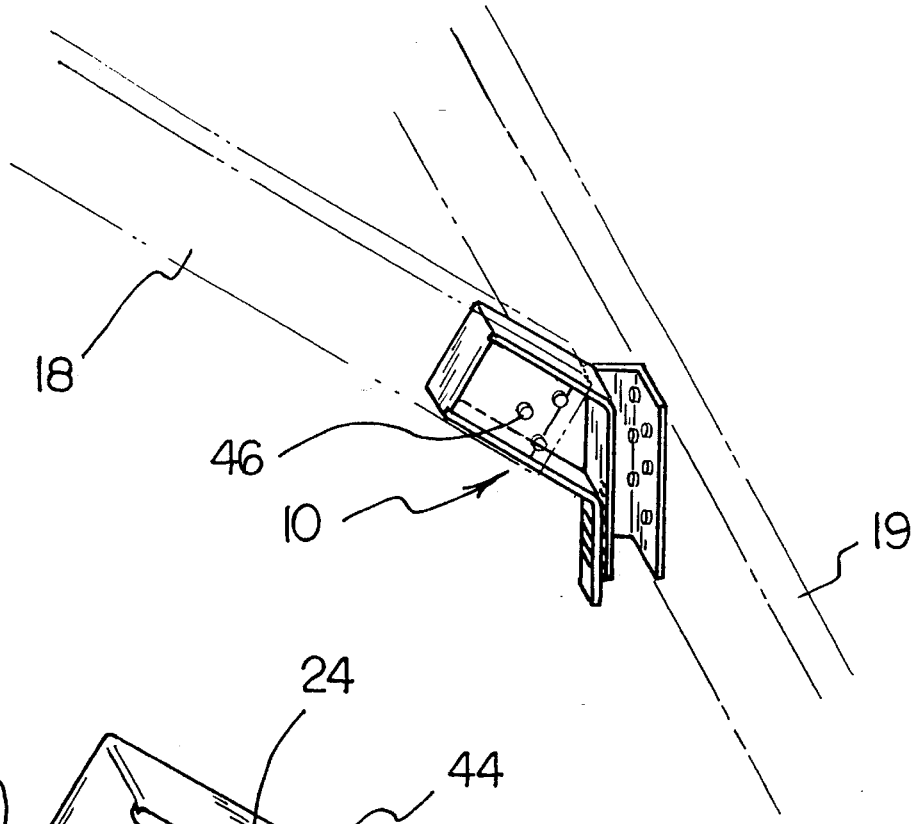
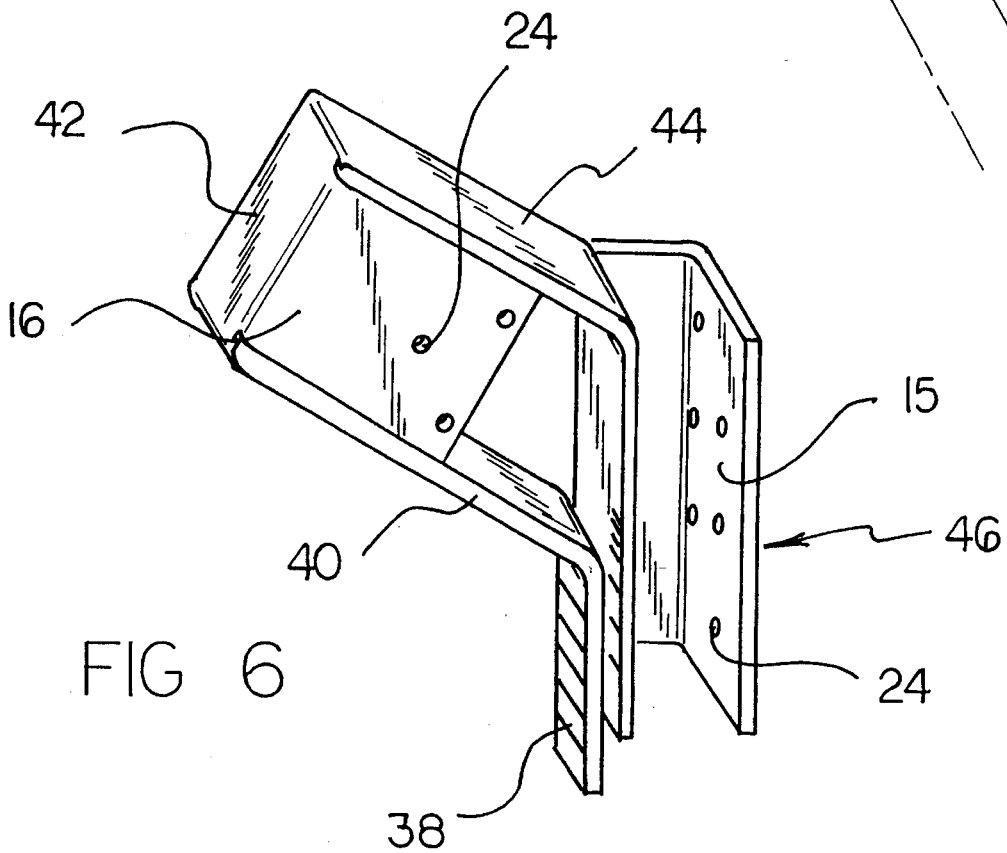
FIG 6

FIG 9
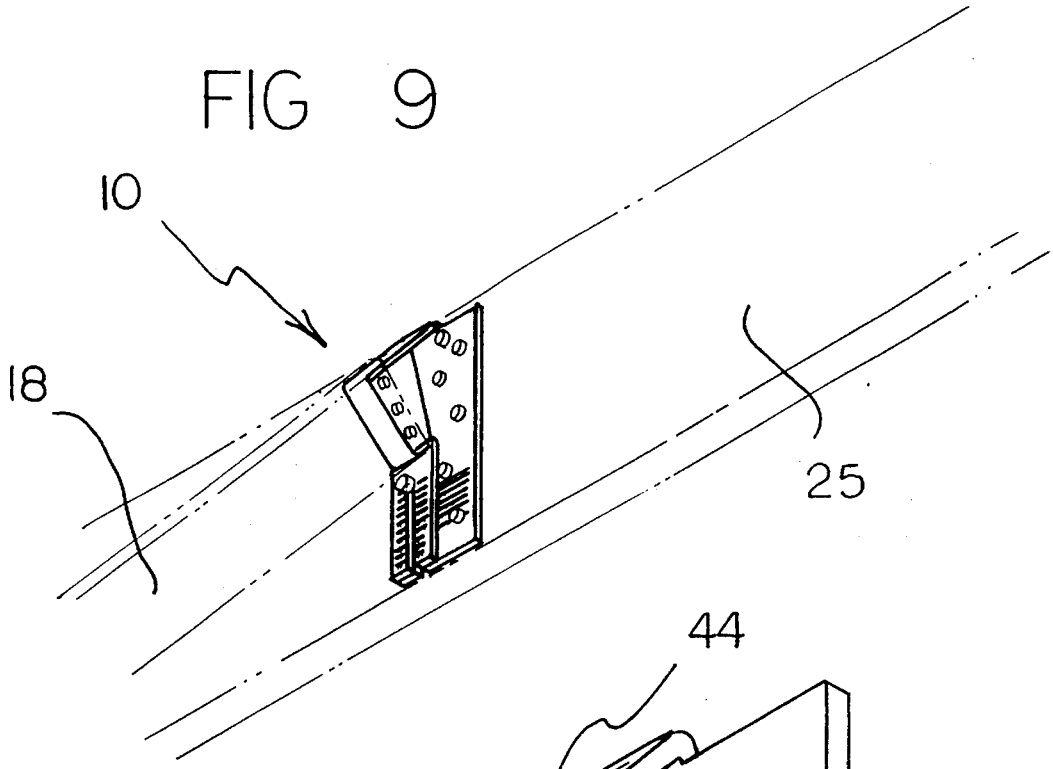
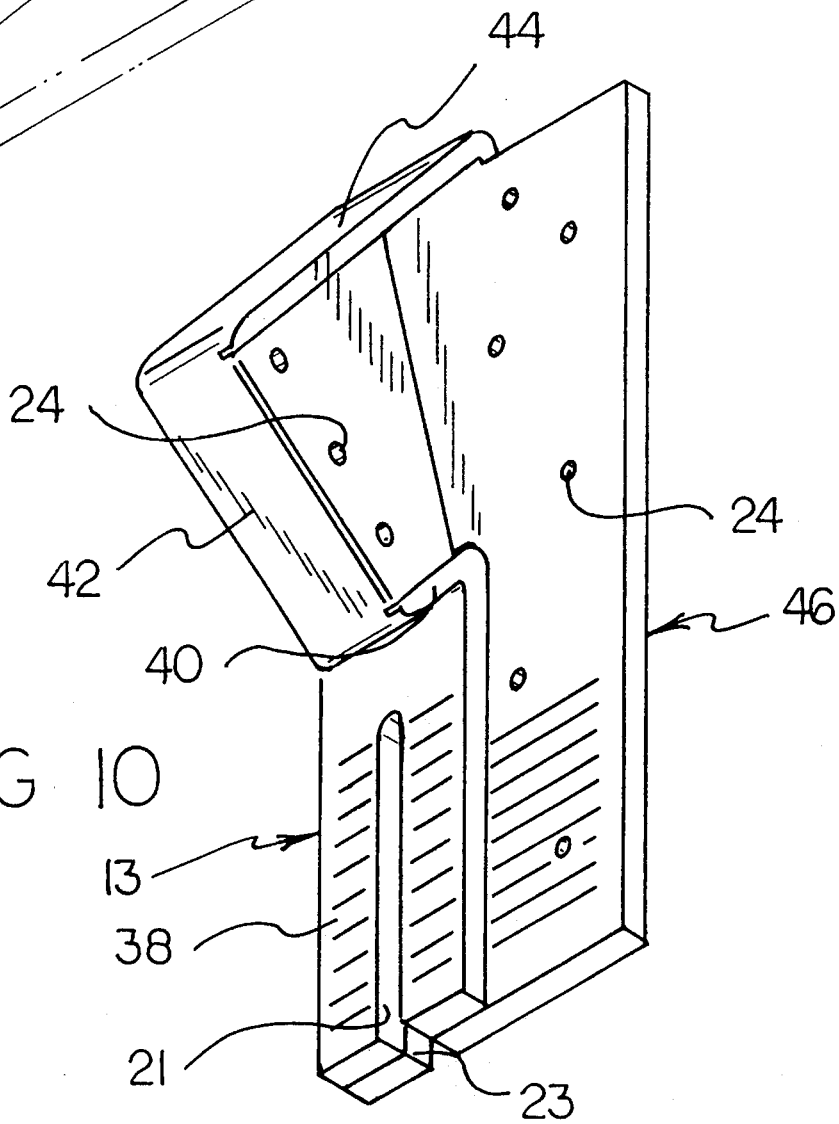
FIG 10

RAFTER-TO-SUPPORT-MEMBER CONNECTION APPARATUS

BACKGROUND OF THE INVENTION

1. Field of the Invention

The present invention relates generally to devices for connecting roofs to underlying structures and, more particularly, to devices especially adapted for connecting roof rafters to structures underlying the rafters.

2. Description of the Prior Art

A variety of structures may be present that underlie roof rafters. In this respect, a variety of types of connection devices are employed for connecting the rafters to the underlying structures. When both the rafters and the underlying structures are made of wood, the rafters and the underlying structures may be connected together by the use of nails. However, when the rafters are made of wood but the underlying structures are made of metal, the simple use of nails will not be satisfactory. Conversely, the rafters may be made of metal, and the underlying structures may be made of wood. In this case also, the simple use of nails to connect the rafters to the underlying structures will not be satisfactory. Therefore, it would be desirable if a connection device were provided to connect a wooden rafter to an underlying metal structure. Similarly, it would be desirable if a connection device were provided to connect a metal rafter to an underlying wooden structure. Still further, it would be desirable if a connection device were provided to connect a metal rafter to an underlying metal structure.

There are a number of types of connections between rafters and underlying structures. More specifically, there is an adjustable birds mouth rafter connection; there is an adjustable fascia rafter connection; there is an adjustable plumb end valley rafter connection; there is an adjustable plumb end hip rafter connection; and there is an adjustable plumb end common rafter connection. In view of the above, it would be desirable to provide a rafter-to-support-member connection for an adjustable fascia rafter connection, an adjustable plumb end valley rafter connection, an adjustable plumb end hip rafter connection, and an adjustable plumb end common rafter connection.

Throughout the years, a number of innovations have been developed relating to connecting different structural components together during building construction, and the following U.S. Pat. Nos. are representative of some of those innovations: 5,104,252; 5,197,241; 5,236,273; 5,249,404; and 5,253,465. It is noted that U.S. Pat. Nos. 5,197,241 and 5,236,273 are directly concerned with connecting rafters to underlying structures.

Still other features would be desirable in a rafter-to-support-member connection apparatus. For example, it would be desirable if a rafter-to-support-member connection apparatus were made from a single blank of sheet metal material. In this regard, it would be desirable for a single blank to be adaptable to a variety of angular orientations between rafters and underlying structures. To facilitate adaptation of a single blank to a variety of angular orientations, it would be desirable for a single blank to include a variety of indicia that indicated a variety of bend lines to accommodate a variety of angular orientations. For a blank to be adapted for bending so that a rafter-to-support-member connection apparatus can be formed, the blank should have a longitudinal portion and one or more transverse portions extending transversely from the longitudinal portion. For a rafter-to-support-member connection apparatus to be easily used, it should have a plurality of apertures through which nails, bolts, or other fastening devices can freely pass. To be readily used at a construction site, it would be desirable for the metal blank to be pre-bent to a large extent before being brought to the construction site, leaving final bending to occur at the construction site.

Thus, while the foregoing body of prior art indicates it to be well known to use connection devices for connecting rafters to underlying structures, the prior art described above does not teach or suggest a rafter-to-support-member connection apparatus which has the following combination of desirable features: (1) connects a wooden rafter to an underlying metal structure; (2) connects a metal rafter to an underlying wooden structure; (3) connects a metal rafter to an underlying metal structure; (4)provides a rafter-to-support-member connection for an adjustable fascia rafter connection, an adjustable plumb end valley rafter connection, an adjustable plumb end hip rafter connection, and an adjustable plumb end common rafter connection; (5) is made from a single blank of sheet metal material; (6) is adaptable to a variety of angular orientations between rafters and underlying structures; (7) includes indicia that indicate a variety of bend lines to accommodate a variety of angular orientations; (8) has a longitudinal portion and one or more transverse portions extending transversely from the longitudinal portion; (9) has a plurality of apertures through which nails, bolts, or other fastening devices can freely pass; and (10) provides a metal blank that is pre-bent to a large extent before being brought to the construction site, leaving final bending to occur at the construction site. The foregoing desired characteristics are provided by the unique rafter-to-support-member connection apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a rafter-to-support-member connection apparatus which includes a single-piece, substantially two-dimensional blank which includes a longitudinal portion and a first transverse portion projecting transversely from the longitudinal portion. The longitudinal portion includes a first end region and a second end region. The first transverse portion includes transverse connection apertures. A plurality of indicia are located at predetermined crease line locations on the longitudinal portion. The first transverse portion and the first end region and the second end region of the longitudinal portion are adapted to be bent with respect to each other along predetermined locations on the first transverse portion and the longitudinal portion to form a three-dimensional structure.

In one embodiment, the longitudinal portion includes longitudinal connection apertures. The first transverse portion is shaped in a form of a fight triangle. The first end region of the longitudinal portion is bent to be perpendicular to a mid-portion of the longitudinal portion in a first plane, the second end region of the longitudinal portion is bent to be perpendicular to the mid-portion of the longitudinal portion in a second plane. The first plane and the second plane are parallel to each other, and the first transverse portion is bent perpendicular to the mid-portion of the longitudinal portion in a third plane which is perpendicular to both the first plane and the second plane.

In a second embodiment, the first end region of the longitudinal portion includes a top region area and a bottom region area, and the mid-portion of the longitudinal portion includes a top mid-portion area and a bottom mid-portion area. The second end region of the longitudinal portion includes indicia for preselected roof pitch indicators, and further includes a second transverse portion projecting transversely from the second end region of the longitudinal portion. The second transverse portion is adapted to be bent into a U-shaped structure. The bottom mid-portion area is adapted to be bent away from the U-shaped structure at an obtuse angle with respect to the second end region of the longitudinal portion. The top mid-portion area of the mid-portion is adapted to be bent at right angles with respect to the bottom mid-portion area. The bottom region area of the first end region is adapted to be bent at right angles to with respect to the top mid-portion area. The top region area of the longitudinal portion is adapted to be bent at an obtuse angle with respect to the bottom region area of the first end region, and the first transverse portion is adapted to be bent at a right angle between the bent bottom mid-portion area and the bottom region area, whereby a three-dimensional structure is formed. The first transverse portion is rectangular shaped. The second transverse portion is rectangular shaped.

In a third embodiment, the first end region of the longitudinal portion includes a top region area and a bottom region area. The top region area includes a first open-ended slot; the mid-portion of the longitudinal portion includes a top mid-portion area and a bottom mid-portion area; and the second end region of the longitudinal portion includes a second open-ended slot. In addition, a second transverse portion projects transversely from the second end region of the longitudinal portion. The second transverse portion includes indicia for preselected roof pitch indicators. The bottom mid-portion area is adapted to be bent away from the U-shaped structure at an acute angle with respect to the second end region of the longitudinal portion and with respect to the second transverse portion. The top mid-portion area of the mid-portion is adapted to be bent at a right angle with respect to the bottom mid-portion area. The bottom region area of the first end region is adapted to be bent at a right angle to with respect to the top mid-portion area. The top region area of the longitudinal portion is adapted to be bent at an acute angle with respect to the bottom region area of the first end region. The first open-ended slot is placed in registration with the second open-ended slot, and the first transverse portion is adapted to be bent at a right angle with respect to the top mid-portion area between the bent bottom mid-portion area and the bottom region area, whereby a three-dimensional structure is formed. The first transverse portion is trapezoidal shaped and The second transverse portion is rectangular shaped.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved rafter-to-support-member connection apparatus which has all of the advantages of the prior art and none of the disadvantages.

It is another object of the present invention to provide a new and improved rafter-to-support-member connection apparatus which may be easily and efficiently manufactured and marketed.

It is a further object of the present invention to provide a new and improved rafter-to-support-member connection apparatus which is of durable and reliable construction.

An even further object of the present invention is to provide a new and improved rafter-to-support-member connection apparatus which is susceptible of a low cost of manufacture with regard to both materials and labor, and which accordingly is then susceptible of low prices of sale to the consuming public, thereby making such rafter-to-support-member connection apparatus available to the buying public.

Still yet a further object of the present invention is to provide a new and improved rafter-to-support-member connection apparatus which connects a wooden rafter to an underlying metal structure.

Still another object of the present invention is to provide a new and improved rafter-to-support-member connection apparatus that connects a metal rafter to an underlying wooden structure.

Yet another object of the present invention is to provide a new and improved rafter-to-support-member connection apparatus which connects a metal rafter to an underlying metal structure.

Even another object of the present invention is to provide a new and improved rafter-to-support-member connection apparatus that provides a rafter-to-support-member connection for an adjustable fascia rafter connection, an adjustable plumb end valley rafter connection, an adjustable plumb end hip rafter connection, and an adjustable plumb end common rafter connection.

Still a further object of the present invention is to provide a new and improved rafter-to-support-member connection apparatus which is made from a single blank of sheet metal material.

Yet another object of the present invention is to provide a new and improved rafter-to-support-member connection apparatus that is adaptable to a variety of angular orientations between rafters and underlying structures.

Still another object of the present invention is to provide a new and improved rafter-to-support-member connection apparatus which includes indicia that indicate a variety of bend lines to accommodate a variety of angular orientations.

Yet another object of the present invention is to provide a new and improved rafter-to-support-member connection apparatus that has a longitudinal portion and one or more transverse portions extending transversely from the longitudinal portion.

Still a further object of the present invention is to provide a new and improved rafter-to-support-member connection apparatus that has a plurality of apertures through which nails, bolts, or other fastening devices can freely pass.

Yet another object of the present invention is to provide a new and improved rafter-to-support-member connection apparatus which for the metal blank to be pre-bent to a large extent before being brought to the construction site, leaving final bending to occur at the construction site.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 a perspective view showing a first preferred embodiment of a rafter-to-support-member connection apparatus of the invention in the form of an adjustable fascia rafter connection apparatus connecting a rafter to a fascia.

FIG. 2 is an enlarged perspective view of the adjustable fascia rafter connection apparatus of the invention shown in FIG. 1 removed from the rafter and the fascia.

FIG. 5 is a perspective view showing a second preferred embodiment of a rafter-to-support-member connection apparatus of the invention in the form of an adjustable plumb end valley rafter connection apparatus connecting a structural rafter to a valley rafter.

FIG. 6 is an enlarged perspective view of the adjustable plumb end valley rafter connection apparatus of the invention shown in FIG. 5 removed from the structural rafter and the valley rafter.

FIG. 9 is a perspective view showing a third preferred embodiment of a rafter-to-support-member connection apparatus of the invention in the form of an adjustable plumb end rafter connection apparatus connecting a rafter to a ridge FIG. 10 is an enlarged perspective view of the adjustable plumb end rafter connection apparatus of the invention shown in FIG. 9 removed from the rafter and the ridge beam.

DESCRIPTION OF THE PREFERRED EMBODIMENT

With reference to the drawings, a new and improved rafter-to-support-member connection apparatus embodying the principles and concepts of the present invention will be described.

Figure 3:
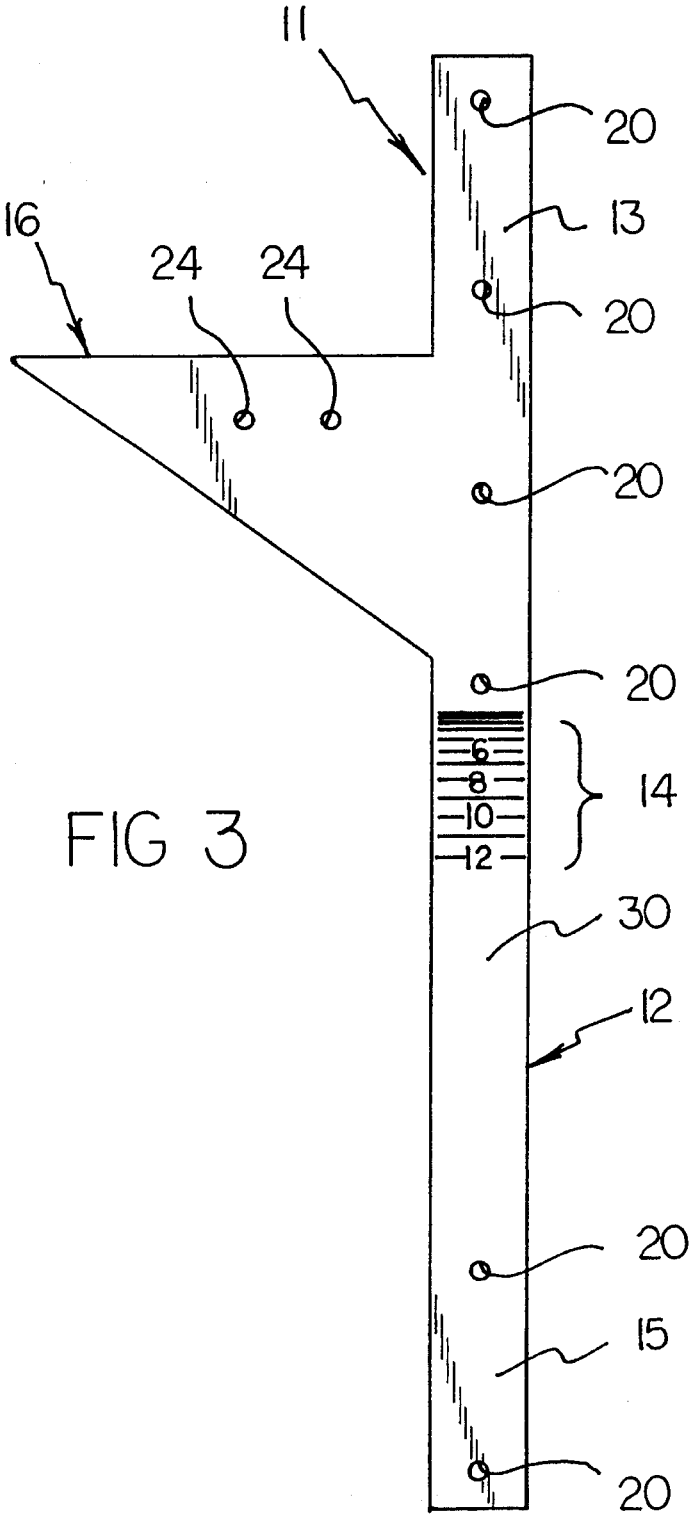
FIG. 3 is a side view of a single-piece blank that is shaped to form the adjustable fascia rafter connection apparatus shown in FIG. 1.
Figure 4:
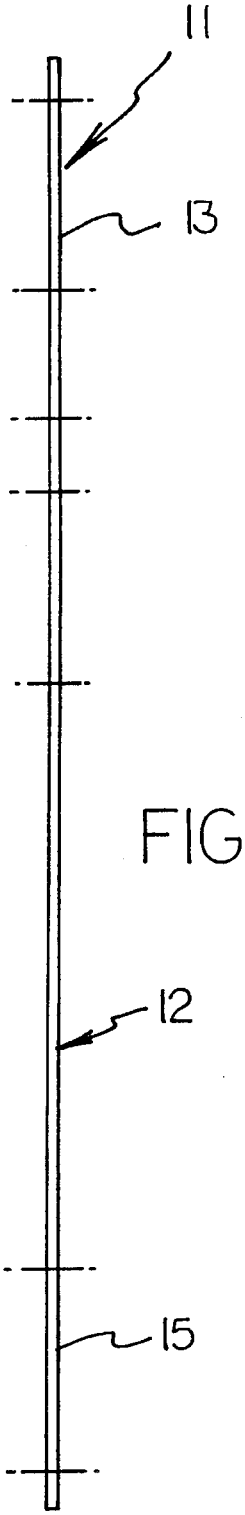
FIG. 4 is an edge view of the single-piece blank shown in FIG. 3.

Turning to FIGS. 1–4, there is shown a first embodiment of the rafter-to-support-member connection apparatus of the invention generally designated by reference numeral 10. In its preferred form, rafter-to-support-member connection apparatus 10 includes a single-piece, substantially two-dimensional blank 11 which includes a longitudinal portion 12 and a first transverse portion 16 projecting transversely from the longitudinal portion 12. The longitudinal portion 12 includes a first end region 13 and a second end region 15. The first transverse portion 16 includes transverse connection apertures 24, and a plurality of indicia 14 located at predetermined crease line locations on the longitudinal portion 12. The first transverse portion 16 and the first end region 13 and the second end region 15 of the longitudinal portion 12 are adapted to be bent with respect to each other along predetermined locations on the first transverse portion 16 and the longitudinal portion 12 to form a three-dimensional structure.

As shown in FIGS. 1 and 2, the longitudinal portion 12 includes longitudinal connection apertures 20. The first transverse portion 16 is triangular shaped. The first transverse portion 16 is shaped in a form of a right triangle. Connector elements 26, such as nails or screws, are placed through the longitudinal connection apertures 20, and the transverse connection apertures 24 interconnect a rafter 18 with another building component, which, as shown in FIG. 1, can be a fascia 28. In this respect, the rafter-to-support-member connection apparatus 10 is in the form of an adjustable fascia rafter connection.

As shown in FIGS. 1 and 2, the first end region 13 of the longitudinal portion 12 is bent to be perpendicular to a mid-portion 30 of the longitudinal portion 12 in a first plane 32, the second end region 15 of the longitudinal portion 12 is bent to be perpendicular to the mid-portion 30 of the longitudinal portion 12 in a second plane 34. The first plane 32 and the second plane 34 are parallel to each other, and the first transverse portion 16 is bent perpendicular to the mid-portion 30 of the longitudinal portion 12 in a third plane 36 which is perpendicular to both the first plane 32 and the second plane 34.

The adjustable fascia rafter connection apparatus described in FIGS. 1–4 is easily used to connect a wood or metal fascia to the plumb end of a structural metal rafter. The fascia connector will be mounted to the rafter with screws. The purpose of the connector apparatus is to (a) provide a convenient connection for a wood or metal fascia at the plumb end of a metal rafter and (b) provide a functional, as well as environmentally sensitive, alternative to conventionally cut wood roofs. The connector will be cut out of light gauge sheet metal in the designed shape, the gauge of the metal to be determined by the specific structural stresses to be encountered during use. The blank for the connector will preferably be bent into ninety percent of its overall shape for use during manufacture. The remaining ten percent of shaping will be performed by the installer. This is done by performing the last two bends on the desired roof pitch crease lines selected from the indicia 14 and then mounting the connector to the metal rafter. Once this is completed, the fascia board can be is connected using screws by screwing through the fascia into the plum face of the connector.

Figure 7:
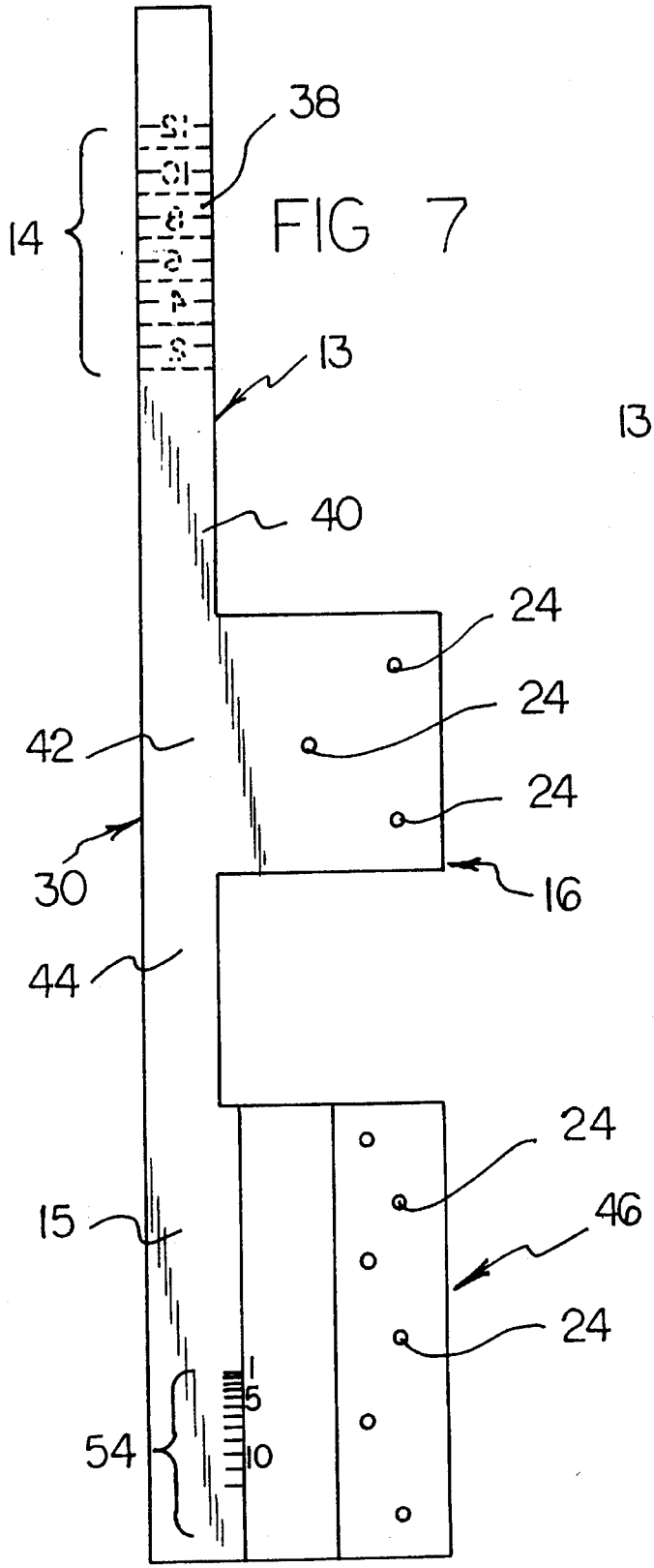
FIG. 7 is a side view of a single-piece blank that is shaped to form the adjustable plumb end valley rafter connection apparatus shown in FIG. 5.
Figure 8:
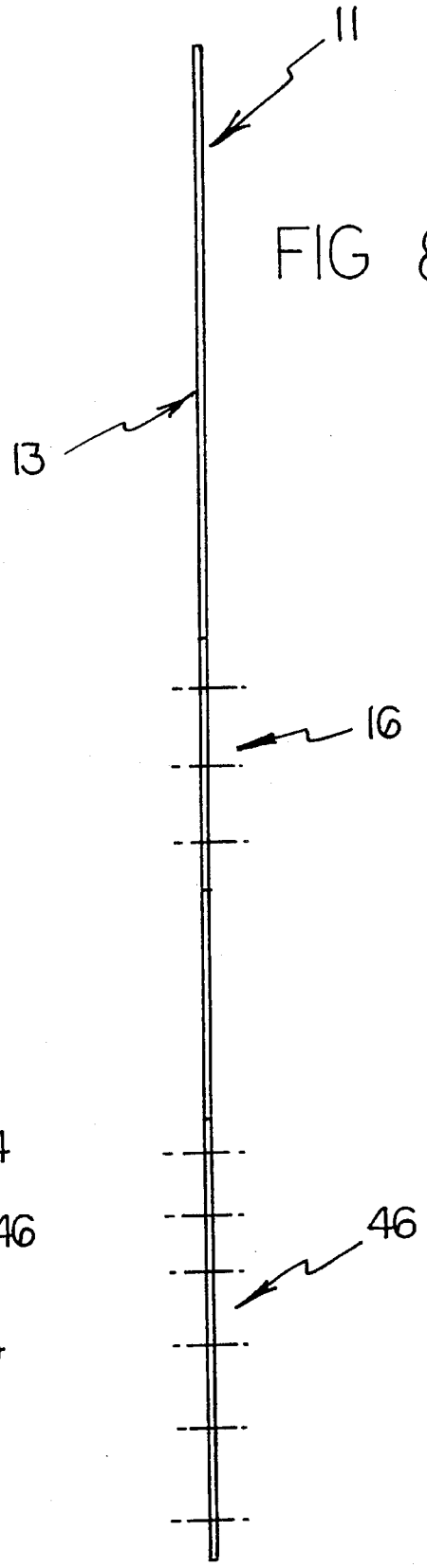
FIG. 8 is an edge view of the single-piece blank shown in FIG. 7.

Turning to FIGS. 5–8, a second embodiment of the invention is shown. Reference numerals are shown that correspond to like reference numerals that designate like elements shown in the other figures. The first end region 13 of the longitudinal portion 12 includes a top region area 38 and a bottom region area 40, and the mid-portion 30 of the longitudinal portion 12 includes a top mid-portion area 42 and a bottom mid-portion area 44. The second end region 15 of the longitudinal portion 12 includes indicia 54 for preselected roof pitch indicators, further includes a second transverse portion 46 projecting transversely from the second end region 15 of the longitudinal portion 12. The second transverse portion 46 is adapted to be bent into a U-shaped structure. The bottom mid-portion area 44 is adapted to be bent away from the U-shaped structure at an obtuse angle with respect to the second end region 15 of the longitudinal portion 12. The top mid-portion area 42 of the mid-portion 30 is adapted to be bent at right angles with respect to the bottom mid-portion area 44. The bottom region area 40 of the first end region 13 is adapted to be bent at right angles to with respect to the top mid-portion area 42. The top region area 38 of the longitudinal portion 12 is adapted to be bent at an obtuse angle with respect to the bottom region area 40 of the first end region 13, and the first transverse portion 16 is adapted to be bent at a right angle between the bent bottom mid-portion area 44 and the bottom region area 40, whereby a three-dimensional structure is formed.

The first transverse portion 16 is rectangular shaped. The second transverse portion 46 is rectangular shaped. More specifically, the embodiment of the invention shown in FIGS. 5–8 relates to an adjustable plumb end valley rafter connection. The plumb end valley rafter connection apparatus is easily used to connect a structural metal tubing valley jack rafter 18 to a wood or metal valley rafter 19. The metal tubing valley jack rafter will be mounted to the plumb end connector with screws 46. The rafter connector can be mounted with either screws or nails depending upon the valley rafter material. The purpose of the connector apparatus is to (a) provide a convenient connection to the valley rafter for a square cut structural metal tubing valley jack rafter and (b) provide a functional, as well as environmentally sensitive, alternative to conventionally cut wood roofs.

The connector will be cut out of light gauge sheet metal in the designed shape, the gauge of the metal and the number and location of the transverse connection apertures 24 to be determined by the specific structural stresses to be encountered during use. The blank for the connector will preferably be bent into ninety percent of its overall shape for use during manufacture. The remaining ten percent of shaping will be performed by the installer. This is done by performing the last bend on the desired roof pitch crease line selected from the indicia 14 and then mounting the connector to the valley rafter. The installers final step is to line up the roof pitch crease line with the proper roof pitch on the roof pitch indicator among indicia 54 and permanently set the roof pitch by nailing or screwing through the roof pitch nail/screw slot. Once this is complete, the square cut "c-channel" shape of the structural metal valley jack rafter slides over the connector and is mounted with screws through the valley jack rafter and screw plate of the connector. Once this is completed you have a valley jack rafter set at the desired roof pitch.

Figure 11:
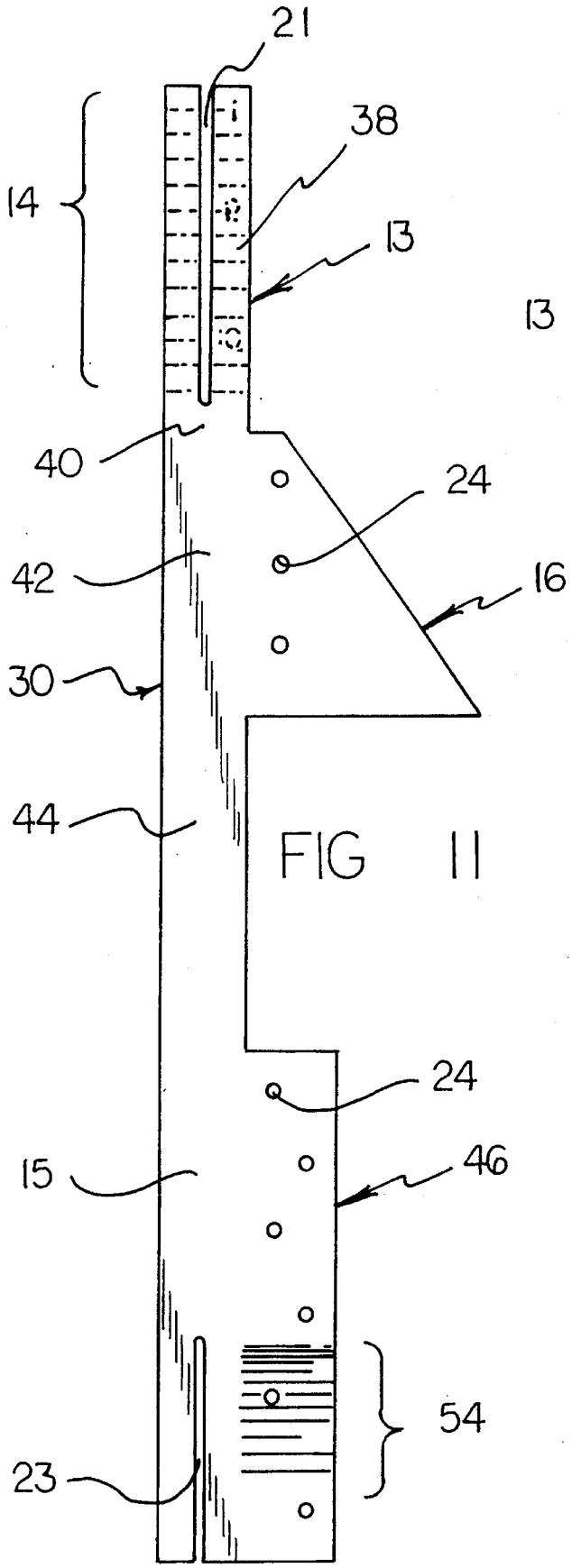
FIG. 11 is a side view of a single-piece blank that is shaped to form the adjustable plumb end rafter connection apparatus shown in FIG. 10.
Figure 12:
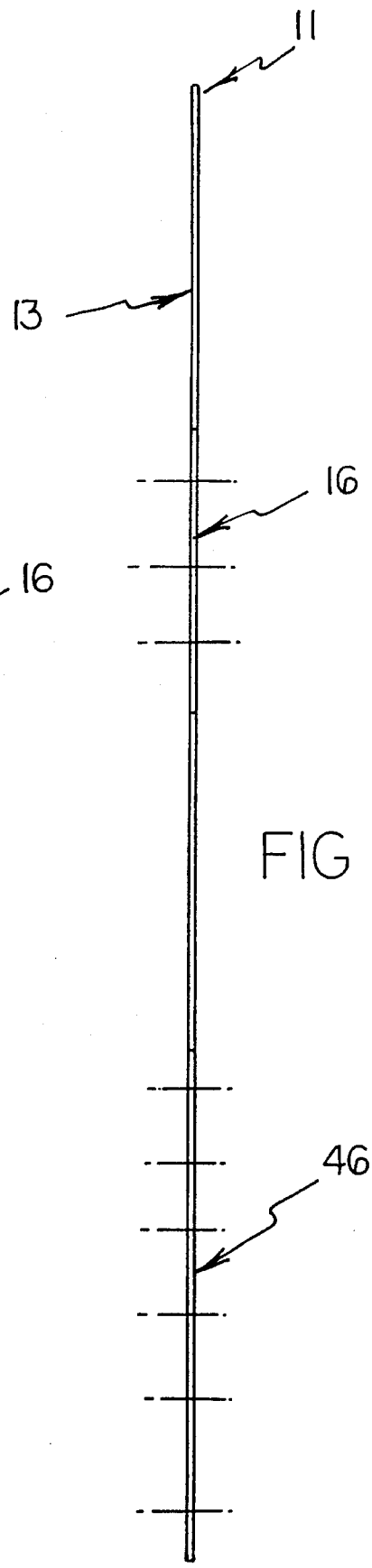
FIG.12 is an edge view of the single-piece blank shown in FIG. 11.

Turning to FIGS. 9–12, a third embodiment of the invention is shown. Reference numerals are shown that correspond to like reference numerals that designate like elements shown in the other figures. In addition, the first end region 13 of the longitudinal portion 12 includes a top region area 38 and a bottom region area 40. The top region area 38 includes a first open-ended slot 21. The mid-portion 30 of the longitudinal portion 12 includes a top mid-portion area 42 and a bottom mid-portion area 44. The second end region 15 of the longitudinal portion 12 includes a second open-ended slot 23. A second transverse portion 46 projects transversely from the second end region 15 of the longitudinal portion 12. The second transverse portion 46 includes indicia 54 for preselected roof pitch indicators. The bottom mid-portion area 44 is adapted to be bent away from the U-shaped structure at an acute angle with respect to the second end region 15 of the longitudinal portion 12 and with respect to the second transverse portion 46. The top mid-portion area 42 of the mid-portion 30 is adapted to be bent at a right angle with respect to the bottom mid-portion area 44. The bottom region area 40 of the first end region 13 is adapted to be bent at a right angle to with respect to the top mid-portion area 42. The top region area 38 of the longitudinal portion 12 is adapted to be bent at an acute angle with respect to the bottom region area 40 of the first end region 13. The first open-ended slot 21 is placed in registration with the second open-ended slot 23, and the first transverse portion 16 is adapted to be bent at a right angle with respect to the top mid-portion area 42 between the bent bottom mid-portion area 44 and the bottom region area 40, whereby a three-dimensional structure is formed.

The first transverse portion 16 is trapezoidal shaped and The second transverse portion 46 is rectangular shaped. More specifically, the embodiment of the invention shown in FIGS. 9–12 relates to an adjustable plumb end common rafter connection. The plumb end connection apparatus is easily used to connect a structural metal tubing rafter 18 to a wood or metal ridge beam 25. The metal tubing rafter 18 is connected to the plumb end connector with screws 46. The rafter connector can be mounted with either screws or nails depending upon the ridge beam material. The purpose of the connector apparatus is to (a) provide a convenient connection to the ridge beam for a square cut structural metal common rafter and (b) provide a functional, as well as environmentally sensitive, alternative to conventionally cut wood roofs.

The connector will be cut out of light gauge sheet metal in the designed shape, the gauge of the metal and the number and location of the transverse connection apertures 24 to be determined by the specific structural stresses to be encountered during use. The blank for the connector will preferably be bent into ninety percent of its overall shape for use during manufacture. The remaining ten percent of shaping will be performed by the installer. This is done by performing the last bend on the desired roof pitch crease line selected from the indicia 14 and then mounting the connector to the ridge beam. The installers final step is to line up the roof pitch crease line with the proper roof pitch on the roof pitch indicator of indicia 54 and permanently set the roof pitch by nailing or screwing through the roof pitch nail/screw slot. Once this is complete, the square cut "c-channel" shape of the structural metal rafter slides over the connector and is mounted with screws through the valley jack rafter and screw plate of the connector. Once this is completed you have a rafter set at the desired roof pitch.

Still other embodiments of the rafter-to-support-member connection apparatus 10 of the invention are contemplated. The following is a description for an adjustable birds mouth rafter connection. The birds mouth connection apparatus is easily used to connect a structural metal rafter to a wood or metal wall top plate. The metal rafter will be is connected to the birds mouth connector with screws. The birds mouth connector can be mounted with either nails or screws depending upon the top plate material. The purpose of the connector apparatus is to (a) provide a convenient connection at the wall top plate for a structural metal rafter and (b) provide a functional, as well as environmentally sensitive, alternative to conventionally cut wood roofs. The connector will be cut out of light gauge sheet metal in the designed shape, the gauge of the metal to be determined by the specific structural stresses to be encountered during use. The blank for the connector will preferably be bent into ninety percent of its overall shape for use during manufacture. The remaining ten percent of shaping will be performed by the installer. This is done by performing the last bend on the desired roof pitch crease line of indicia 14 and then mounting the connector to the wall top plate. The final step of the installer will be to use the roof pitch ruler to permanently set the desired roof pitch. This will be performed by lining up the desired roof pitch line of indicia 54 flush with the top of the wall top plate and nailing or screwing through the roof pitch nail/screw slot into the top plate forming a mounting bracket at the proper roof pitch. Once this is completed, the metal rafter can be mounted to the connector with screws by screwing through the screw plate into the metal rafter.

The following is a description for an adjustable plumb hip rafter connection. The plumb end rafter connector apparatus is easily used to connect a structural metal jack rafter to a wood or metal hip rafter. The metal jack rafter will be is connected to the plumb end rafter connector with screws. The plumb end rafter connector can be mounted with either nails or screws depending upon the hip rafter material. The purpose of the connector apparatus is to (a) provide a convenient connection to the hip rafter for a square cut structural metal jack rafter and (b) provide a functional, as well as environmentally sensitive, alternative to conventionally cut wood roofs. The connector will be cut out of light gauge sheet metal in the designed shape, the gauge of the metal to be determined by the specific structural stresses to be encountered during use. The blank for the connector will preferably be bent into ninety percent of its overall shape for use during manufacture. The remaining ten percent of shaping will be performed by the installer. This is done by performing the last bend on the desired roof pitch crease line of indicia 14 and then mounting the connector to the hip rafter. The final step of the installer will be to line up the roof pitch crease line of indicia 14 with the proper roof pitch on the desired roof pitch line of indicia 54 and permanently set the roof pitch by nailing or screwing through the roof pitch nail/screw slot. Once the mounting is completed, the square cut "c-channel" shape of the structural metal jack rarer slides over the connector and is mounted with screws through the jack rafter and screw plate of the connector. Once this is completed, there will be a jack rafter set at the desired roof pitch.

The components of the rafter-to-support-member connection apparatus of the invention can be made from inexpensive and durable sheet metal materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved rafter-to-support-member connection apparatus that is low in cost, relatively simple in design and operation, and which may advantageously be used to provide a rafter-to-support-member connection apparatus which connects a wooden rafter to an underlying metal structure. With the invention, a rafter-to-support-member connection apparatus is provided which connects a metal rafter to an underlying wooden structure. With the invention, a rafter-to-support-member connection apparatus is provided which connects a metal rafter to an underlying metal structure. With the invention, a rafter-to-support-member connection apparatus provides a rafter-to-support-member connection for an adjustable fascia rafter connection, an adjustable plumb end valley rafter connection, an adjustable plumb end hip rafter connection, and an adjustable plumb end common rafter connection. With the invention, a rafter-to-support-member connection apparatus is provided which is made from a single blank of sheet metal material.

With the invention, a rafter-to-support-member connection apparatus is provided which is adaptable to a variety of angular orientations between rafters and underlying structures. With the invention, a rafter-to-support-member connection apparatus is provided which includes indicia that indicate a variety of bend lines to accommodate a variety of angular orientations. With the invention, a rafter-to-support-member connection apparatus is provided which has a longitudinal portion and one or more transverse portions extending transversely from the longitudinal portion. With the invention, a rafter-to-support-member connection apparatus is provided which has a plurality of apertures through which nails, bolts, or other fastening devices can freely pass. With the invention, a rafter-to-support-member connection apparatus is provided which has a metal blank that is pre-bent to a large extent before being brought to the construction site, leaving final bending to occur at the construction site.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A rafter-to-support-member connection apparatus, comprising:

a single-piece, substantially two-dimensional blank which includes a longitudinal portion and a single transverse portion projecting transversely from said longitudinal portion, wherein said longitudinal portion includes a first end region and a second end region, wherein said single transverse portion includes transverse connection apertures, and a plurality of indicia located at predetermined crease line locations on said longitudinal portion, wherein said single transverse portion and said first end region and said second end region of said longitudinal portion are adapted to be bent with respect to each other along predetermined locations on said single transverse portion and said longitudinal portion to form a three-dimensional structure, wherein said longitudinal portion includes longitudinal connection aperture, and wherein said single transverse portion is triangular shaped.

2. The apparatus of claim 1 wherein said first transverse portion is shaped in a form of a right triangle.

3. A three-dimensional structure obtained by bending the apparatus of claim 1, comprising:

said first end region of said longitudinal portion bent perpendicular to a mid-portion of said longitudinal portion in a first plane, said second end region of said longitudinal portion bent perpendicular to said mid-portion of said longitudinal portion in a second plane, wherein said first plane and said second plane are parallel to each other, and said single transverse portion bent perpendicular to said mid-portion of said longitudinal portion in a third plane which is perpendicular to both said first plane and said second plane.

* * * * *